US008374876B2

(12) United States Patent
Black et al.

(10) Patent No.: US 8,374,876 B2
(45) Date of Patent: Feb. 12, 2013

(54) SPEECH GENERATION USER INTERFACE

(75) Inventors: Rolf Black, Dundee (GB); Annula Waller, Dundee (GB); Eric Abel, Dundee (GB); Iain Murray, Dundee (GB); Graham Pullin, Dundee (GB)

(73) Assignee: The University of Dundee, Dundee (GB)

( * ) Notice: Subject to any disclaimer, the term of this patent is extended or adjusted under 35 U.S.C. 154(b) by 1003 days.

(21) Appl. No.: 12/223,358

(22) PCT Filed: Feb. 1, 2007

(86) PCT No.: PCT/GB2007/000349

§ 371 (c)(1),
(2), (4) Date: Oct. 15, 2008

(87) PCT Pub. No.: WO2007/088370

PCT Pub. Date: Aug. 9, 2007

(65) Prior Publication Data

US 2009/0313024 A1 Dec. 17, 2009

(30) Foreign Application Priority Data

Feb. 1, 2006 (GB) ..... 0601988.9

(51) Int. Cl.
*G10L 21/06* (2006.01)
*G10L 13/00* (2006.01)
*G09B 19/04* (2006.01)

(52) U.S. Cl. ..... 704/271; 704/258; 434/185

(58) Field of Classification Search ..... None
See application file for complete search history.

(56) References Cited

U.S. PATENT DOCUMENTS 4,618,985 A * 10/1986 Pfeiffer ..... 704/261
4,661,916 A * 4/1987 Baker et al. ..... 704/260
4,788,649 A * 11/1988 Shea et al. ..... 704/267
5,047,952 A * 9/1991 Kramer et al. ..... 704/271
5,317,671 A * 5/1994 Baker et al. ..... 704/271
(Continued)

FOREIGN PATENT DOCUMENTS

EP 0471572 A 2/1992
FR 2881863 A 8/2006

OTHER PUBLICATIONS

Perlin, "Quikwriting: Continuous Stylus-based Text Entry", Proceedings of the 11th annual ACM symposium on User interface software and technology, pp. 215-216, 1998.*

(Continued)

*Primary Examiner* — Brian Albertalli
(74) *Attorney, Agent, or Firm* — Edwards Wildman Palmer LLP; George N. Chaclas

(57) ABSTRACT

A system and a method for speech generation which assist the speech of those with a disability or a medical condition such as cerebral palsy, motor neurone disease or a dysarthia following a stroke. The system has a user interface having a multiplicity of states each of which correspond to a sound and a selector for making a selection of a state or a combination of states. The system also has a processor for processing the selected state or combination of states and an audio output for outputting the sound or combination of sounds. The sounds associated with the states can be phonemes or phonics and the user interface is typically a manually operable device such as a mouse, trackball, joystick or other device that allows a user to distinguish between states by manipulating the interface to a number of positions.

21 Claims, 14 Drawing Sheets

U.S. PATENT DOCUMENTS

| | | | | |
|---|---|---|---|---|
| 5,953,693 | A * | 9/1999 | Sakiyama et al. | 704/3 |
| 6,148,286 | A | 11/2000 | Siegel | |
| 6,490,563 | B2 * | 12/2002 | Hon et al. | 704/260 |
| 6,708,152 | B2 * | 3/2004 | Kivimaki | 704/260 |
| 7,286,115 | B2 * | 10/2007 | Longe et al. | 345/168 |
| 7,310,513 | B2 * | 12/2007 | Bulthuis et al. | 455/412.1 |
| 7,565,295 | B1 * | 7/2009 | Hernandez-Rebollar | 704/271 |
| 7,788,100 | B2 * | 8/2010 | Slotznick et al. | 704/270.1 |
| 2002/0145587 | A1 | 10/2002 | Watanabe | |
| 2009/0055192 | A1 * | 2/2009 | Liebermann | 704/271 |

OTHER PUBLICATIONS d'Alessandro et al., "The Speech Conductor: Gestural Control of Speech Synthesis", eNTERFACE 2005 the Summer Workshop on Multimodal Interfaces, pp. 52-61, 2005.*

Pausch et al., "Giving CANDY to Children: User-Tailored Gesture Input Driving an Articulator-Based Speech Synthesizer", Communications of the ACM, vol. 35 Issue 5, May 1992.*

The International Search Report in PCT/GB2007/000349 dated May 3, 2007.

* cited by examiner

Sound selection:
round, open or wide mouth,
hissy, buzzy, poppy, bangy or hummy & singy
Sounds 9: bangy
Choices: b, d, g
Position 9: d
(feedback)
Position 6: g
(feedback)
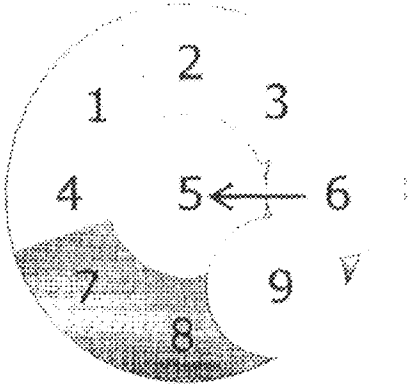
Confirming:
Position 5: g!
(Loud output)
Fig. 4(iii)

Error correction:
same sound level

Position 9: d
(feedback)

Confirming:
Position 9: d!
(Loud output)

80

81

| cp | state | 5 | 1 | 2 | 3 | 4 | 6 | 7 | 8 | 9 |
|---|---|---|---|---|---|---|---|---|---|---|
| | 1 | i | i | ai | oo | h | w | | qu | |
| | 2 | a | e | a | or | f | l | | x | |
| | 3 | o | ee | u | o | | r | | | |
| | 6 | n | er | ue | oa | | n | | | g |
| | 9 | d | | | ou | t_h_ | m | v | p | d |
| | 8 | t | | | oi | sh | n | z | t | b |
| | 7 | j | | | | ch | | j | ck | |
| | 4 | s | ie | ar | o_o_ | s | y | th | | |

83

*Fig. 8*

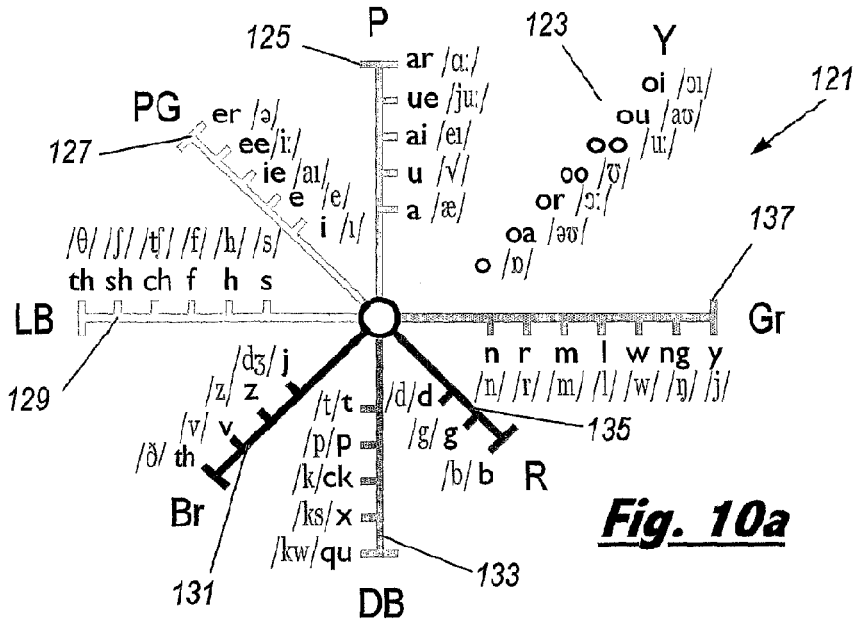

Fig. 10a

| | | | |
|---|---|---|---|
| round mouth | | rounded back vowels | Y |
| open mouth | | open vowels | P |
| wide mouth | | close/front vowels | PG |
| hissy | | voiceless fricatives | LB |
| buzzy | | voiced fricatives | Br |
| poppy | | voiceless plosives | DB |
| bangy | | voiced plosives | R |
| hummy & singy | | nasals & approximants | Gr |

Fig. 10b

| stage 1 | 2 | 3 | 4 | 5 | 6 | 7 |
|---|---|---|---|---|---|---|
| /s/ s | /k/ ck | /g/ g | /eɪ/ ai | /z/ z | /j/ y | /kw/ qu |
| /æ/ a | /e/ e | /ɒ/ o | /dʒ/ j | /w/ w | /ks/ x | /aʊ/ ou |
| /t/ t | /h/ h | /ʌ/ u | /əʊ/ oa | /ŋ/ ng | /tʃ/ ch | /ɔɪ/ oi |
| /ɪ/ i | /r/ r | /l/ l | /aɪ/ ie | /v/ v | /ʃ/ sh | /juː/ ue |
| /p/ p | /m/ m | /f/ f | /iː/ ee | /ʊ/ oo | /ð/ th | /ə/ er |
| /n/ n | /d/ d | /b/ b | /ɔː/ or | /uː/ oo | /θ/ th | /ɑː/ ar |

Fig. 10c

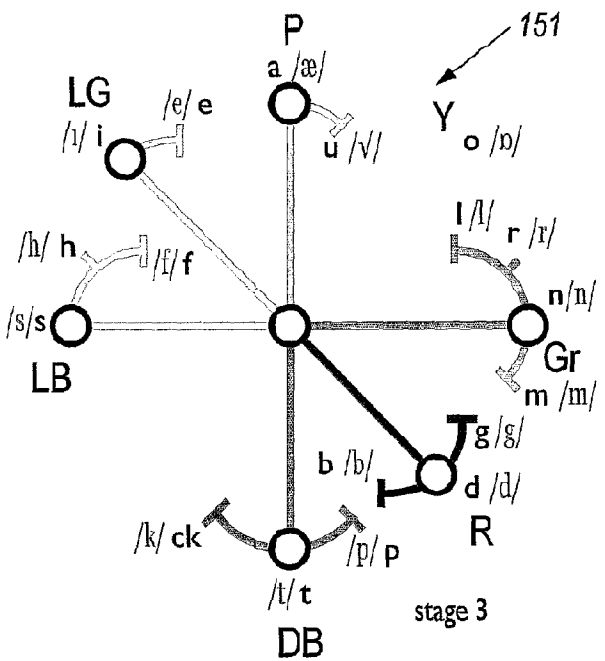
Fig. 11c
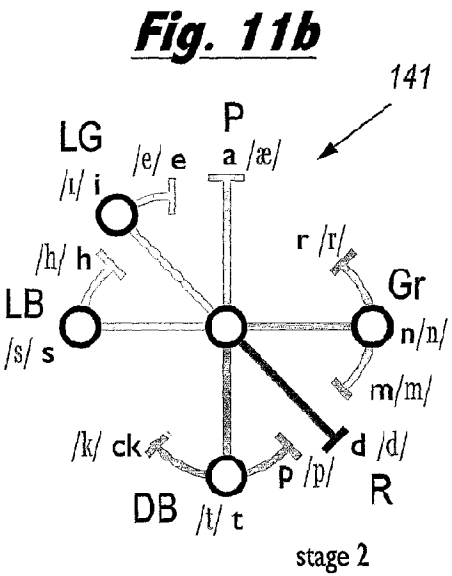
Fig. 11b
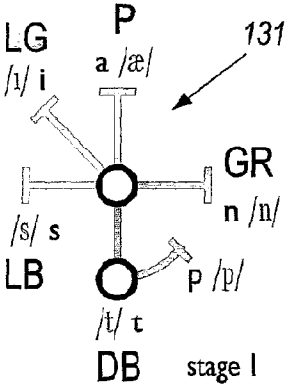
Fig. 11a
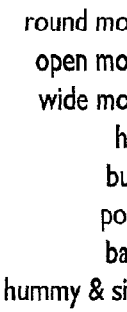

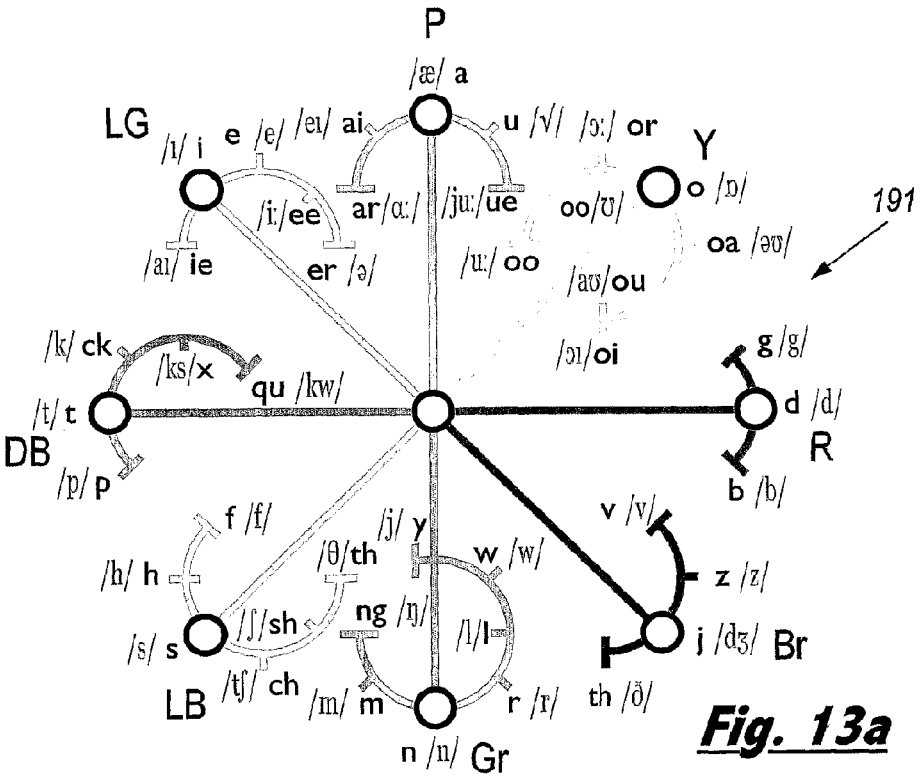
Fig. 13a
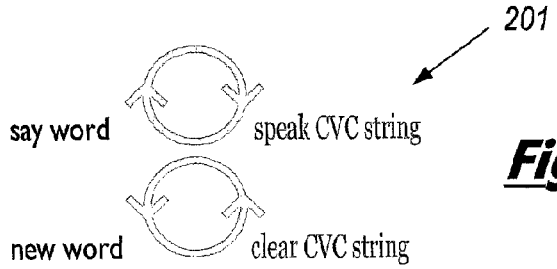
Fig. 13b
| | | | |
|---|---|---|---|
| round mouth | | rounded back vowels | Y |
| open mouth | | open vowels | P |
| wide mouth | | close/front vowels | LG |
| poppy | | voiceless plosives | DB |
| hissy | | voiceless fricatives | LB |
| hummy & singy | | nasals & approximants | Gr |
| buzzy | | voiced fricatives | Br |
| bangy | | voiced plosives | R |
211
Fig. 13c

SPEECH GENERATION USER INTERFACE

CROSS-REFERENCE TO RELATED APPLICATION

This application is the U.S. national phase, pursuant to 35 U.S.C. §371, of international application No. PCT/GB2007/000349, published in English on Aug. 9, 2007 as international publication No. WO 2007/088370 A1, which claims the benefit of British application Ser. No. GB 0601988.9, filed Feb. 1, 2006, the disclosure of which applications are incorporated herein in their entireties by this reference.

BACKGROUND OF THE INVENTION

The present invention relates to speech generation or synthesis. The invention may be used to assist the speech of those with a disability or a medical condition such as cerebral palsy, motor neurone disease or a dysarthia following a stroke.

The invention is not limited to the above applications, but may also be used to enhance mobile or cellular communications technology, for example.

Speech generation or synthesis means the creation of speech other than through the normal interaction of brain, mouth and vocal chords. For those with a physical impairment that affects their ability to speak, the purpose of speech synthesis is to allow the person to communicate by 'talking' to another person.

This may be achieved by using computerised voice synthesis which is linked to a keyboard or other interface such that the user can spell out a word or sentence which will then be 'spoken' by the voice synthesiser.

Such systems only work where the user has already acquired literacy and has lost the ability to speak through some illness or condition after literacy has been acquired. Where the user has not acquired literacy, or loses this ability, it is necessary for the user, in effect, to learn to speak and also to acquire the basic tools of literacy related to reading and writing.

In general, when learning to read and write, two approaches may be adopted. Firstly, a learner may be invited to learn whole words, the way they sound and their meaning. Secondly, the technique known as Synthetic Phonics may be used to allow learners to break words down into their phonemes (the basic sound building blocks of words) and to sound out words.

One way that non-literate users can access words is through the use of communication boards known as lapboards or books. These boards or books are pictorial devices which allow a user to point at a picture for a second person to act as the user's voice by vocalising the sound or word associated with the picture. This system has very obvious limitations because the user is entirely reliant upon the presence and co-operation of someone else. Such circumstances discourage the user from playing or experimenting with sounds and it is known that this type of play or babble is a crucial stage in language development.

In addition there is often no logical connection between different sounds on a lapboard and it is know that certain phoneme combinations occur more readily in a specific language than others.

Computerised voice output communication devices are available which use digitized or synthetic speech to speak out letters/words/phrases. Literate users are able to spell out any number of words. However non-literate users have to use vocabulary stored by others using complex retrieval codes and sequences which impose a high cognitive load on the user. Users are also restricted to the vocabulary and cannot generate novel language as these devices are literacy based systems.

SUMMARY

It is an object of the present invention to provide a system for speech generation It is a further object of the present invention to provide a system for speech generation which is based on sound as opposed to spelling using traditional orthography (alphabetic letters).

It is a further object of the present invention to create a user interface for the system that is adapted to specific user requirements.

In accordance with the first aspect of the invention is provided a system for speech generation, the system comprising:
a user interface having a multiplicity of states each of which correspond to a sound and a selector for making a selection of a state or a combination of states;
processing means for processing the selected state or combination of states; and
an audio output for outputting the sound or combination of sounds.

Preferably, the sounds are phonemes or phonics.

Preferably, the states are grouped in a hierarchical structure.

Optionally, the states are grouped in a series.

Optionally, the states are grouped in parallel.

Preferably, the system comprises a set of primary states that represent a predefined group of sounds.

Preferably, each primary state gives access to one or more secondary states containing the predefined group of sounds.

The user interface may comprise any manually operable device such as a mouse, trackball or other device that allows a user to distinguish between states by manipulating the interface to a plurality of positions.

Preferably, the user interface comprises a joy-stick. Preferably, each state corresponds to a position of the joy stick.

Preferably, the primary states are each represented by one of n movements of the joy stick from an initial position.

Preferably, the secondary states are each represented by one of m movements from the position of the associated primary state.

Preferably, the selector is provided with sound feedback to allow the user to hear the sounds being selected.

Preferably, the sound feedback comprises headphones or a similar personal listening device to allow the user to monitor words as they are being formed from the sounds.

Preferably, the level of sound feedback is adjustable. A novice user can have an entire word sounded out whereas an expert user may wish to use less sound feedback.

Preferably, the processing means is provided with sound merging means for merging together a combination of sounds to form a word.

Sound merging is used to smooth out the combined sounds to make the word sound more natural.

Preferably, the processing means is provided with a memory for remembering words created by the user.

Preferably, the processing means is provided with a module which predicts the full word on the basis of one or more combined sounds forming part of a word.

Preferably, the module outputs words to the sound feedback system.

Preferably, the user interface is provided with a visual display.

Preferably, the visual display is integral to the input device.

Preferably, the visual display contains a graphical representation of the states.

Optionally, the visual display is adapted to operate with the predictive module by displaying a series of known words which the predictive module has predicted might be the full word, based on an initial part of the word defined by selected sounds Preferably, the device will also be capable of being an input device to teaching/learning software which will be operated using a traditional visual display unit.

Preferably, the processing means further comprises a speech chip that produces the appropriate output sound.

Optionally, the speech chip is a synthetic speech processor.

Optionally, the speech chip assembles its output using prerecorded phonemes.

Preferably, the processor operates to encourage the selection of more likely primary and secondary states for subsequent sounds once the primary or secondary state of an initial sound has been selected.

More preferably, the manually operable device is guided by a force-feedback system to make it easier to select certain subsequent sounds after an initial sound has been selected.

Preferably, the force feedback system contains a biasing means.

In accordance with a second aspect of the invention there is provided a method for generating synthetic speech, the method comprising the steps of:

providing a plurality of sounds, said sounds being associated with primary and secondary states of a user interface;

selecting one or more sounds to form output speech; and outputting said one or more sounds.

Preferably, the sounds are phonemes or phonics.

Preferably, the states are grouped in a hierarchical structure.

Optionally, the states are grouped in series.

Optionally, the states are grouped in parallel.

Preferably, each primary state gives access to one or more secondary states containing a predefined group of sounds.

Preferably, the primary states are each represented by one of n movements of a user interface from an initial position.

Preferably, the secondary states are each represented by one of m movements from the position of the associated primary state.

Preferably, the method further comprises providing sound feedback to allow the user to hear the sounds being selected.

Preferably, the method further comprises merging together a combination of sounds to form a word.

Sound merging is used to smooth out the combined sounds to make the word sound more natural.

Preferably, the method further comprises storing words created by the user.

Preferably, predicting the full word on the basis of one or more combined sounds forming part of a word.

Preferably, the method further comprises outputting words to the sound feedback system.

Optionally, method further comprises displaying a series of known words which the predictive module has predicted might be the full word, based on an initial part of the word defined by selected sounds.

Preferably, the output sound is produced by a speech processor.

Optionally, the output sound is created by a synthetic speech processor.

Optionally, the speech chip assembles its output using prerecorded phonemes.

Preferably, the method further comprises encouraging the selection of more likely primary and secondary states for subsequent sounds once the primary or secondary state of an initial sound has been selected.

In accordance with a third aspect of the invention there is provided a computer program for carrying out program instructions for carrying out the method of the second aspect of the invention.

In accordance with a fourth aspect of the invention there is provided a device comprising computing means adapted to run the computer program in accordance with the third aspect of the invention.

Preferably, the device is a mobile communications device.

The mobile communications device may be a cellular telephone or a personal digital assistant.

Alternatively, the device is an educational toy useable to assist the development of language and literacy.

The device may also be configured to assist in the learning of foreign languages where sounds are grouped differently than in the user's mother tongue.

In accordance with a fifth aspect of the invention there is provided a user interface for use with an apparatus and/or method of speech generation, the user interface comprising:

a selection mechanism which allows the interface to choose a first state of the interface in response to operation by a user; and biasing means which operates to encourage the selection of more likely subsequent states based upon the selection of the first state.

Preferably, the interface is a joystick.

More preferably the joystick is guided by a force-feedback system to make it easier to select certain subsequent sounds after an initial sound has been selected.

The selection system is based on the likelihood that certain sounds are grouped together in a specific language or dialect of a language.

BRIEF DESCRIPTION OF THE DRAWINGS

The present invention will now be described by way of example only with reference to the accompanying drawings in which:

FIG. 8 is a look-up table for all phonics used in an example of a system in accordance with the present invention;

FIGS. 10*a*, 10*b* and 10*c* show an example of the layout of various phonics when a joy stick interface is used;

FIGS. 11*a*, 11*b* and 11*c* show a further aspect of the invention in which the number of phonics presented to a user is progressively increased;

FIGS. 13*a*, 13*b* and 13*c* show yet another configuration of phonics when the system is implemented with a joy stick interface;

DETAILED DESCRIPTION OF PREFERRED EMBODIMENTS

The advantages, and other features of the speech generation user interface disclosed herein, will become more readily apparent to those having ordinary skill in the art from the following detailed description of certain preferred embodiments taken in conjunction with the drawings which set forth representative embodiments of the present invention.

Figure 1:
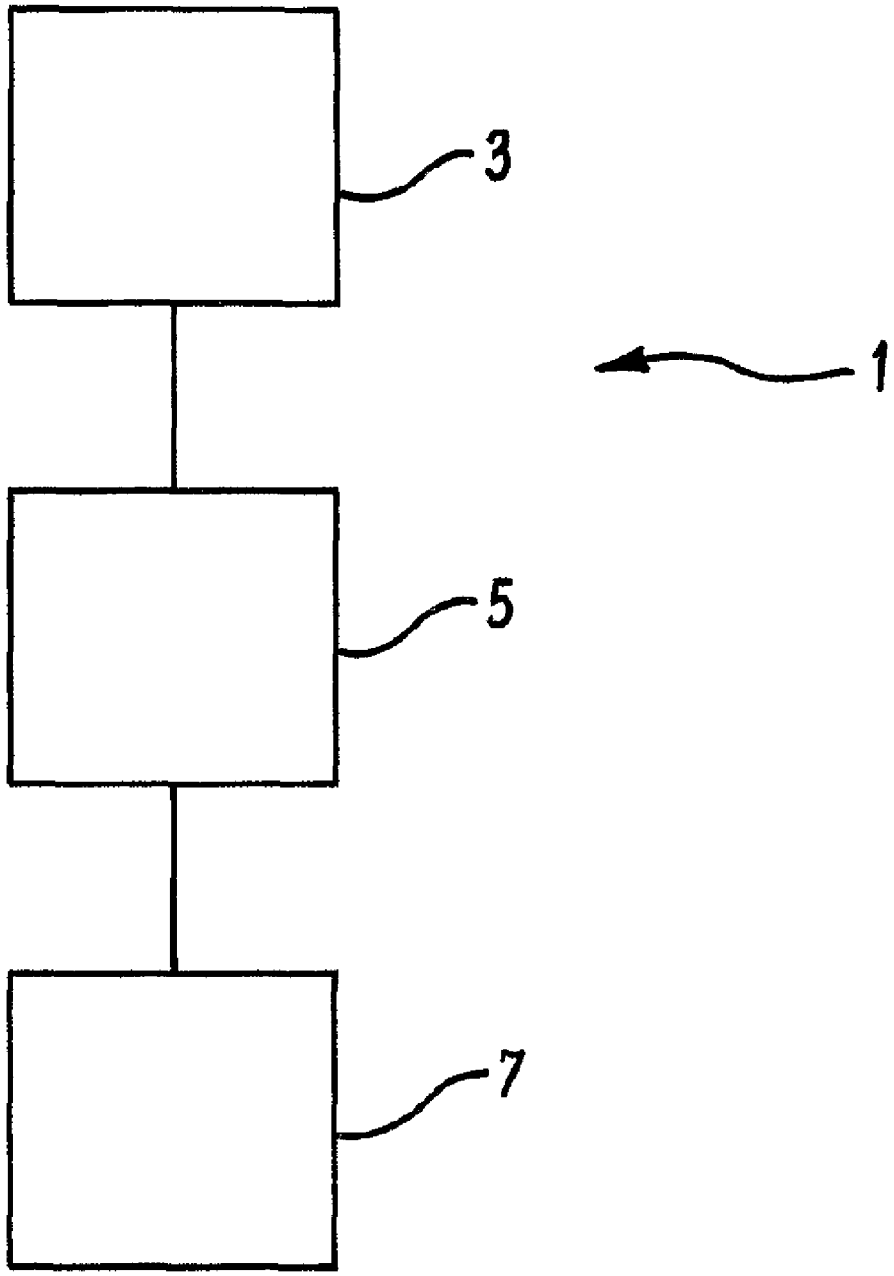
FIG. 1 is a block diagram showing parts of a system in accordance with the present invention.

The system of FIG. 1 comprises an interface 3, a processor 5 and an audio output 7. In this example of the present invention, the interface 3 comprises a joy stick.

Other interfaces may be used; in particular, interfaces that require minimal manipulation by a user and which therefore assist the physically impaired in operating the system are envisaged. In addition, the system may be used to create speech using, for example, the key pad and other interface features of a cellular phone, Blackberry, Personal Digital Assistant or the like. The audio output 7 may comprise an amplifier and speakers adapted to output the audio signal obtained from the processor 5.

Figure 2A:
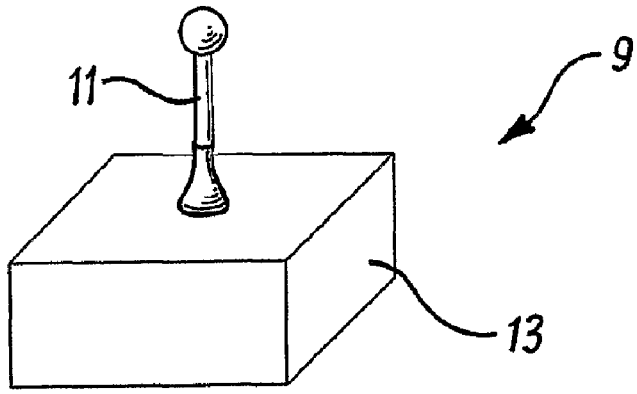
FIG. 2*a* is a user interface, in this case a joy stick for use with the present invention
Figure 2B:
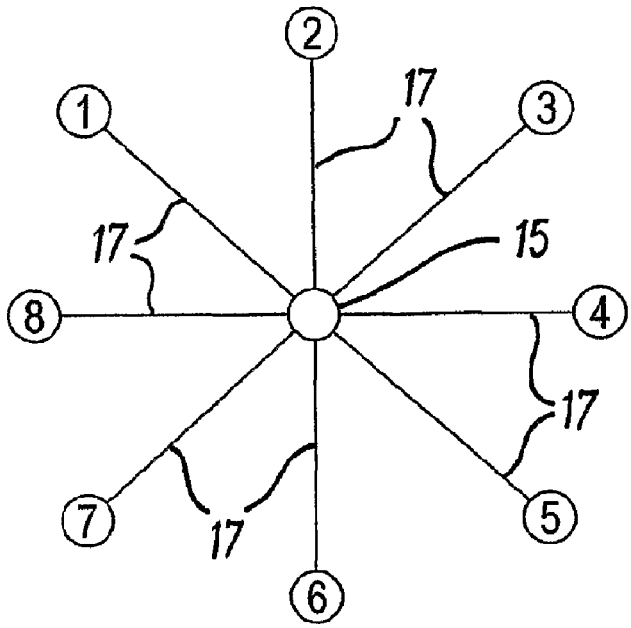
FIG. 2*b* shows the positions of the joy stick which cause the production of a phoneme.

FIG. 2*a* shows a joy stick adapted to be a user interface in accordance with the present invention. The joy stick 9 comprises a base 13 and control 11. FIG. 2*b* shows the eight operational positions, generally shown by reference numeral 17 and numbered 1 to 8. FIG. 2*b* also shows a central position 15. Each of the position 17 is associated with a primary state, each of which defines a group of related sounds, which in this case are phonics.

Figure 3:
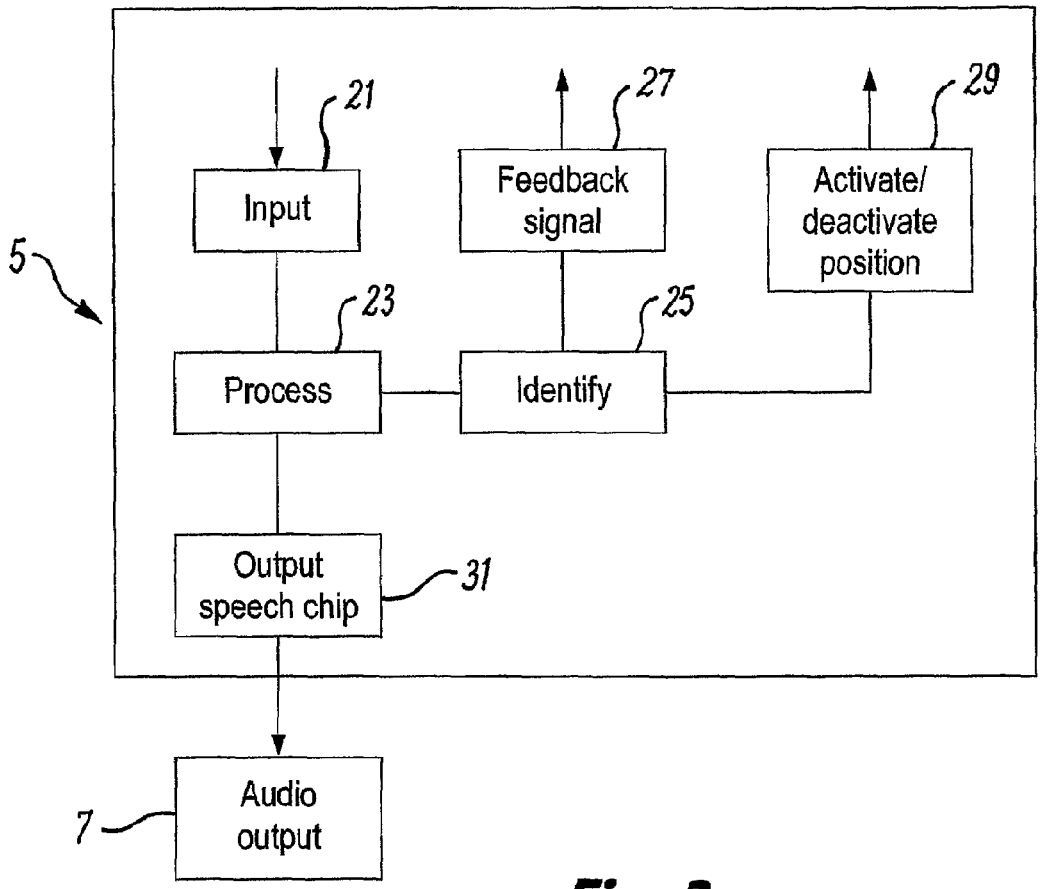
FIG. 3 is a block diagram showing the processor and audio output of a system in accordance with the present invention.

FIG. 3 provides additional operation details of the processor 5. The processor 5 is provided with an input 21 that receives an electrical signal from the user interface (joy stick). The input signal is then provided to a processor 23 which processes the signal which is sent for processing to a speech chip 31 to provide an audio signal for audio output 7.

The processor 23 also provides a signal to identification means 25 which identifies the input signal and therefore the position of the joy stick. As the position of the joy stick is related to a primary state which identifies a group of related phonics, the processor 5 is able to produce a feedback signal 27 which produces resistance against movement of the joy stick in certain directions. These directions relate to sounds which in the particular language of the system, would not ordinarily fit together. This feature is designed to assist the user in forming words by leading the user to use the most likely pairings and groups of phonics.

In addition, the identification of the additional phonic provides an activation and deactivation function 29 which is fed back to the joy stick. This function, as will be seen later is designed to disable certain joy stick positions where those positions do not represent one of the phonics within the group of phonics defined by the primary state. This feature may be combined with the feedback feature such that it is more difficult to move the joy stick into positions which have been disabled.

Figure 4I:
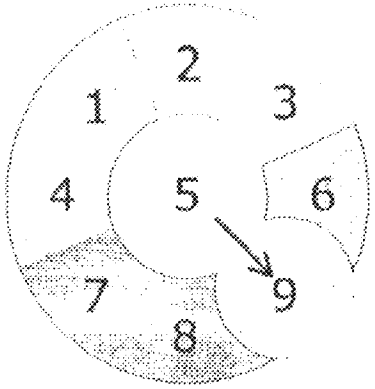
FIG. 4 shows the operation of the user interface in selecting sounds.
Figure 4:
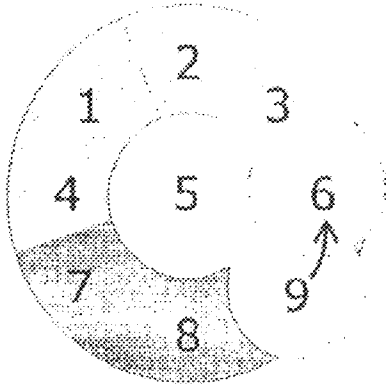

FIG. 4 shows one embodiment of phonic selection. In each of FIGS. 4(*i*), 4 (*ii*) and 4(*iii*), the positions of the joy stick are represented by numbers one to nine, including the neutral position 5 which corresponds to the joy stick being at the centre in effectively a resting position. FIG. 4(*i*) shows the joy stick being moved from position 5 to position 9. Moving to position 9 then provides the choice of three phonics. These are B, D and G. Where the joy stick remains in position 9, the letter D is selected. However, if the joystick is then moved to position 6, as shown in FIG. 4(*ii*), the letter G is selected. Confirmation of selection of letter G is provided by moving the joy stick back from position 6 to the neutral position, position 5.

Figure 5I:
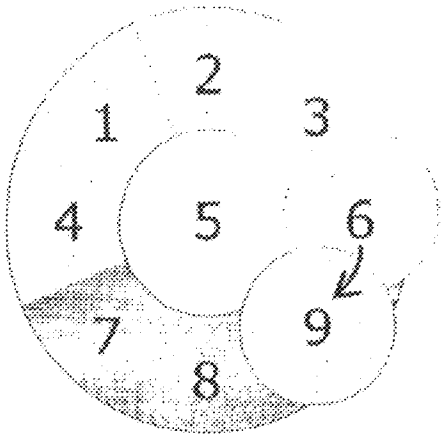
FIG. 5 shows the manner in which the phonic selection may be corrected in a system in accordance with the present invention.
Figure 5:
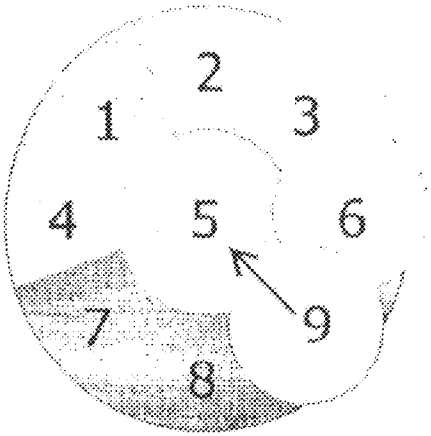

FIG. 5 shows a further feature of the present invention which allows correction of errors where a person has incorrectly or mistakenly selected a certain phonic. FIG. 5(*i*) shows movement of the joy stick from position 6 to position 9, effectively re-tracing the steps from those shown in FIG. 4, and then back to position 5. This re-tracing of the earlier movements cancels the phonic that had been selected.

Figure 6:
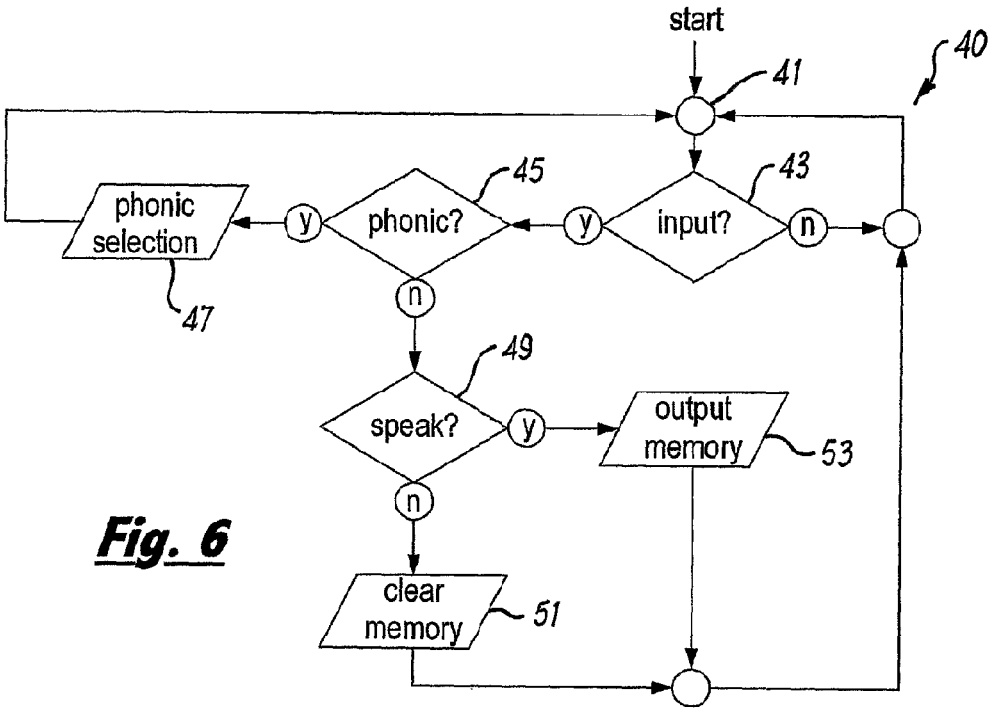
FIG. 6 is a flow diagram showing the process of creating speech with a system in accordance with the present invention.

FIG. 6 is a flow chart showing a speech process used in the present invention. From the start position 41 an input to the system is made. This input may be a phonic or it may be another input from the user interface. Where the input is a phonic, the user can choose to input an additional phonic and continue around the loop from boxes 43, 45 and 47 until the user does not wish to create any additional phonics. Once the user is finished creating phonics, the user will be asked whether the string of phonics should be spoken 49. If the answer is yes, then the string of phonics is output from the memory 53. If not, the memory is cleared and the user may start again.

The present invention provides a means for blending or merging the string of phonics that have been created by the user to remove any disjointedness from the string of phonics and to make the words sound more realistic.

Figure 7:
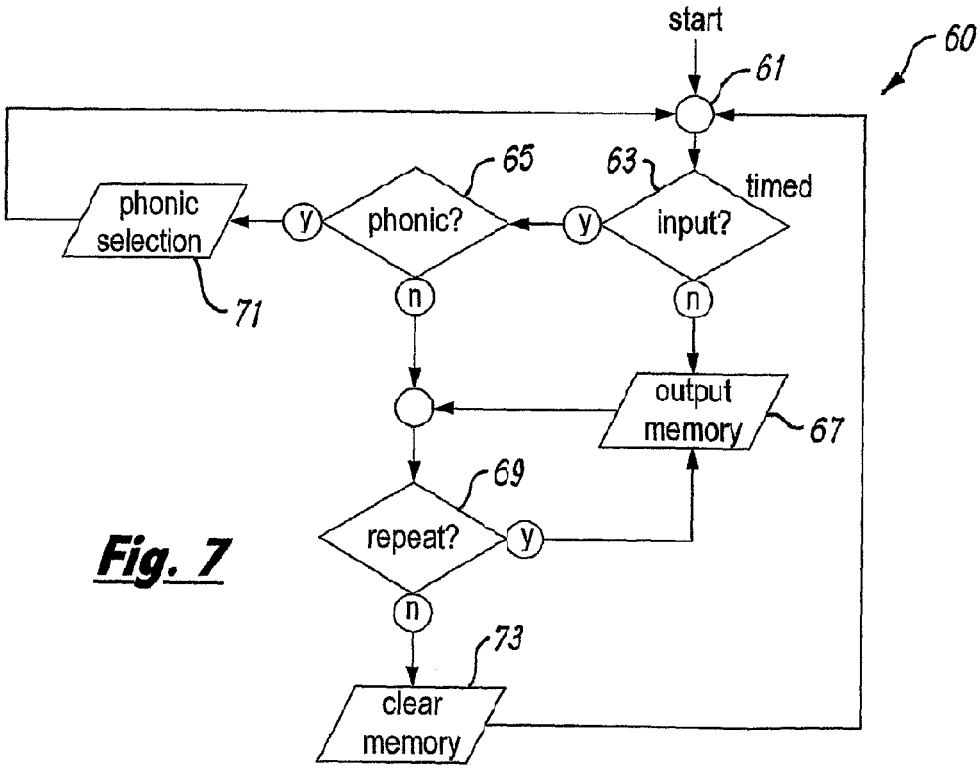
FIG. 7 is a second embodiment of the process of creating speech in accordance with a system of the present invention.

FIG. 7 shows a second example of a speech generation process in accordance with the present invention. In this example, the use of the joy stick or other interface is timed. If an input is provided that is a phonic 65, phonic selection 71 occurs and this process is repeated until the user has selected a series of phonics used to form a word. Once the input operation has been completed, if the user makes no further inputs and a certain predefined time elapses, the selected phonics are output 67. This process may be repeated 69 or if not repeated then the system memory is cleared and the whole process may be started again.

Figure 9:
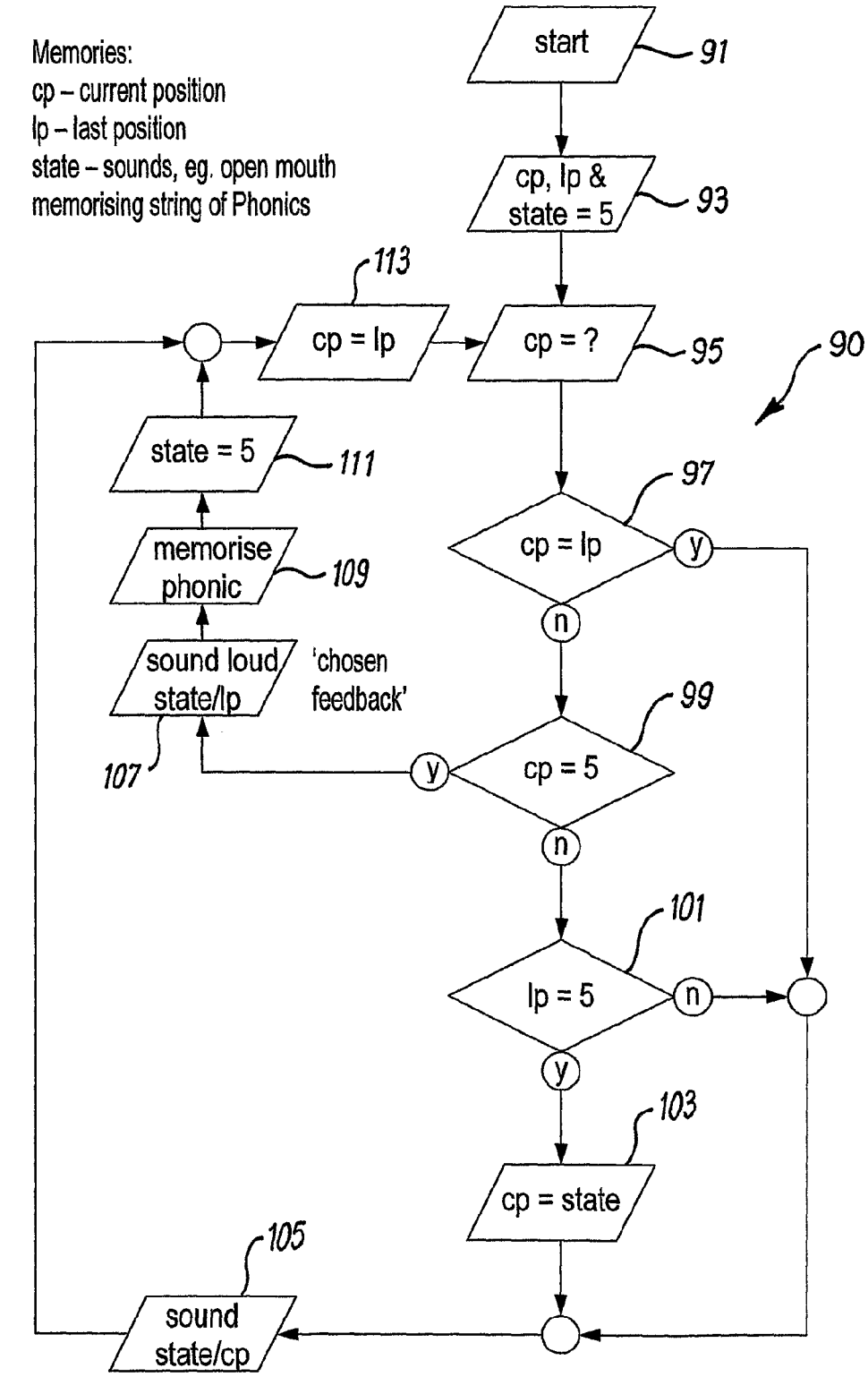
FIG. 9 is a flow chart showing the operation of the look-up table in an example of a system in accordance with the present invention.

FIGS. 8 and 9 provide more detail on the process of phonic selection. FIG. 8 is a look up table which identifies the state 81 and the current position 83 of the user interface and the various phonics that relate to these. When the process is started, the current position, last position and state are identified. As the process commences, the state will equal 5 which is the neutral position of the joy stick as shown previously. Where the joy stick is moved, a new current position 95 will be created and the current position is compared to the last position to see if they are identical. Where the current position and the last position are not identical, if the current position equals 5 then a sound corresponding to the phonic is made 107 and the phonic is stored in the memory. Thereafter the state will be 5 (reference numeral 111). If the current position does not equal 5, then the system asks whether the last position equals 5, if yes, then the current position is equal to the state 103 and a sound corresponding to the state or current position is made 105. If the last position is not 5, then a sound corresponding to the state is output 105.

FIGS. 10*a*, 10*b* and 10*c* show a map of a suitable layout of different position that the joy stick may take in order to produce a series of phonics. FIG. 10*a* shows eight directions in which the joystick may be extended from a central position. FIG. 10*b* is a key to the positions of FIG. 10*a*, showing the top-level phonic types. Each of the eight directions may be produced in colour and colour coded such that arms 1 123, 125, 127, 129, 131, 133, 135, and 137 may be coloured yellow, pink, pale green, light blue, brown, dark blue red and green respectively.

Along each of the arms the various sounds that are divided into groups defined by each of the directions, are shown. The position along the direction, for example 123 for yellow shows the number of times the joy stick must be moved in that direction to produce the sound. For example the "oi" sound is produced when the joy stick is moved seven times in the direction of 123. FIG. 10*c* shows the range of phonics provided for in this embodiment of the intention.

FIGS. 11*a*, 11*b* and 11*c* show a further useful feature of the present invention. In this case, FIG. 11*a* is a simplified set of phonics which is used in the initial stages to train a user. Once the user has mastered this basic set of phonics and also the various movement of the joy stick, they can move onto the more sophisticated schemes shown in FIGS. 11*b* and 11*c*.

A joy stick may be programmed using the processor to produce a more limited set of sounds. Consequently, the system may be used in a learner, intermediate or expert mode depending upon the level of proficiency of the user.

Figure 12A:
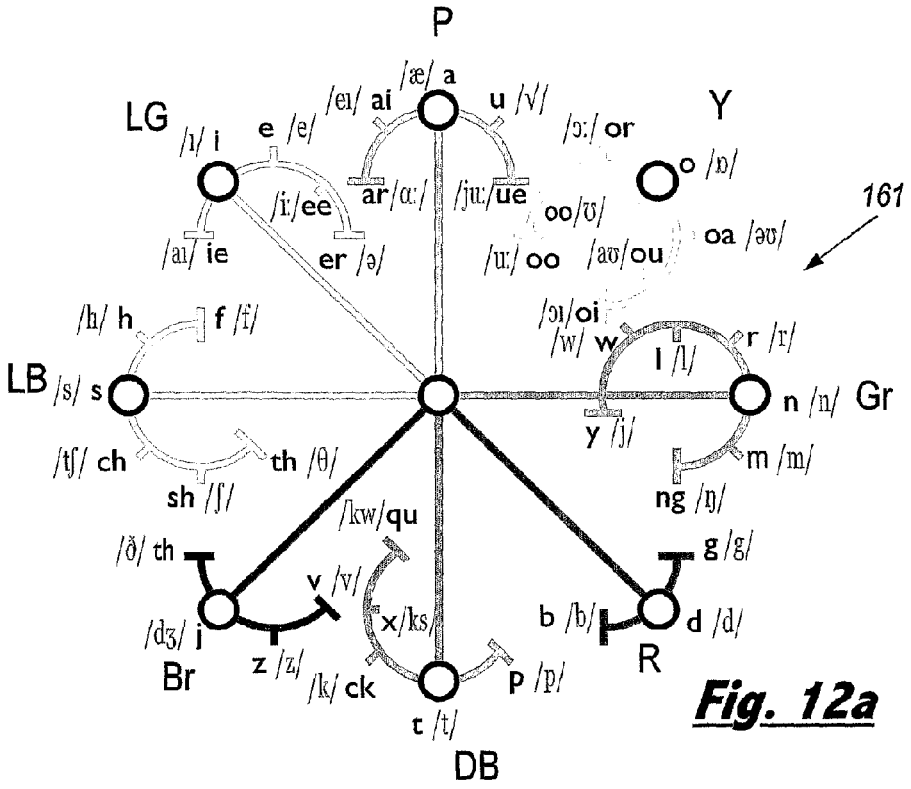
FIGS. 12*a*, 12*b* and 12*c* show a further configuration of phonics implemented by a joy stick interface.
Figure 12B:
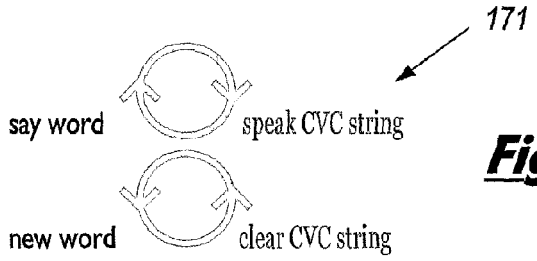
Figure 12C:
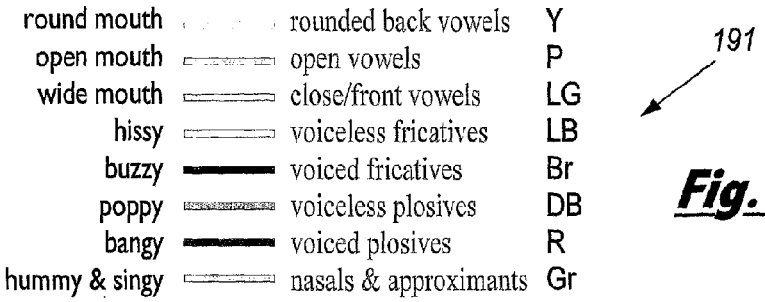

FIGS. 12*a*, 12*b* and 12*c* show a further embodiment of the present invention and a further arrangement of different sounds produced from a joy stick. It will be noted that each of the directions shown in FIG. 11*a*, 161, now defines a simple hierarchy of sounds. For example, should the joy stick be moved directly to the right toward the letter n, this movement then and only then allows a number of other sounds such as "ng", "m", "r", "l", "w" and "y" to be made.

These sounds are made by subsequent movements of the joy stick as described with reference to FIGS. 4 and 5 above. In addition, the use of the central point numbered 5 in FIGS. 4 and 5 can play a crucial role in the selection of sounds. FIG. 12*b* shows the joy stick operation required to say a word and to begin a new word.

Saying a word requires the joy stick to be rotated in a clockwise direction and beginning a new word requires the joy stick to be rotated in an anti-clockwise direction.

FIGS. 13*a*, 13*b* and 13*c* show a further embodiment of joy stick positions for use with the present invention. This arrangement provides different relative positions of the various sounds. Different arrangements of various sounds or phonics may be preferred by some users or may be more suitable for certain dialects or languages.

Figure 14A:
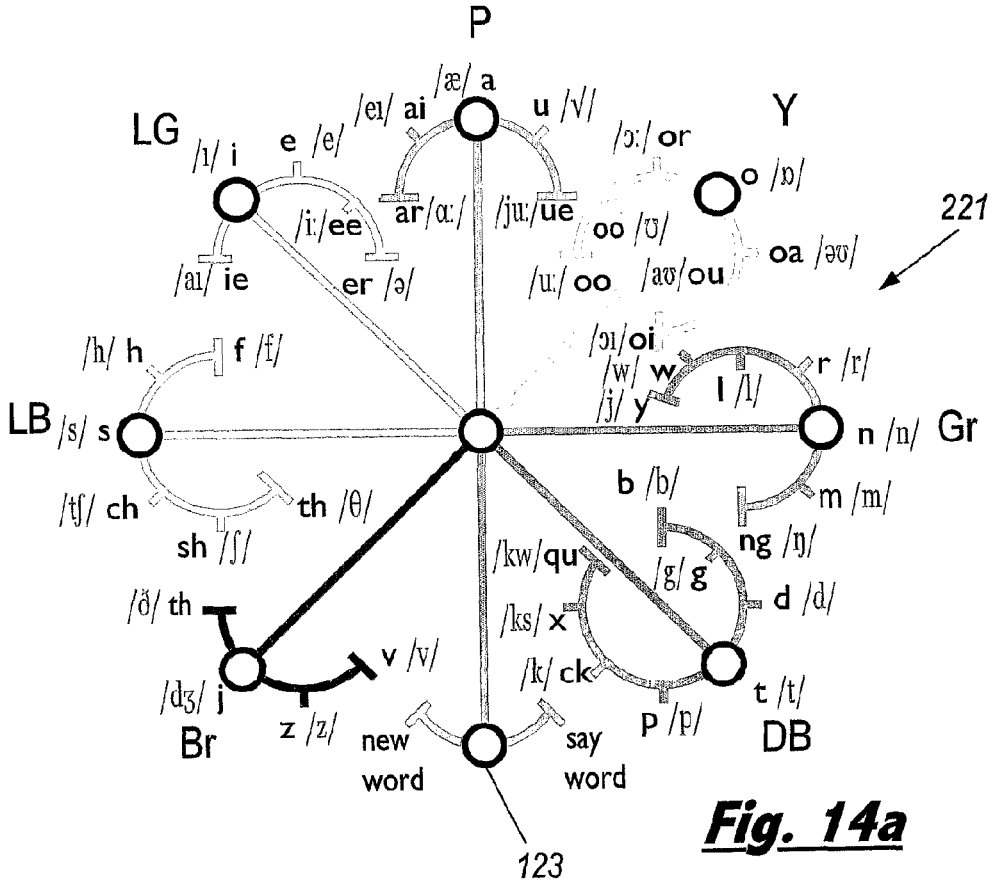
FIGS. 14*a* and 14*b* show a further embodiment of the system of the present invention where the phonics are configured with respect to a joy stick interface.
Figure 14B:
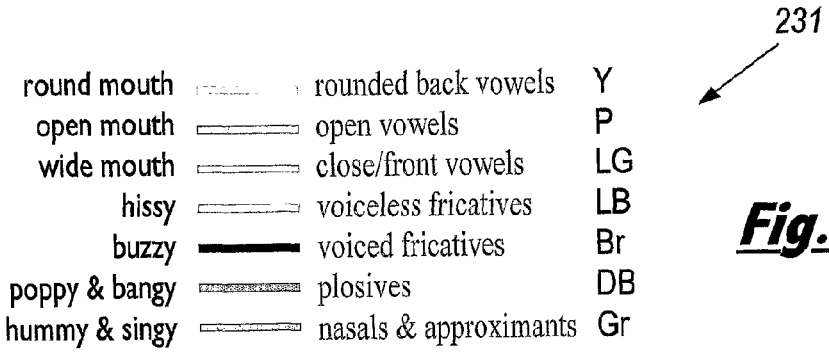

FIGS. 14*a* and 14*b* show a further embodiment of the present invention in which seven primary states are used rather than eight primary states as shown in previous embodiments. In this case, the phonics are simply re-arranged so that they fit into fewer initial direction and the eighth direction 123 is used to provide the functionality to allow the user to say the word or to begin a new word.

The present invention provides a system that allows a user to create sounds using the physical movement of a user interface. The user interface may be a joy stick, a switch, a tracker ball, a head tracking device or other similar interface. In addition it is envisaged that other types of sensors could be used which may respond the movement of a user's muscles or may respond to brain function.

One particular advantage of the present invention is that no inherent literacy is required from the user. As mentioned above, voice synthesis or speech generation systems that are based upon a user spelling words or creating written sentences to be uttered by a speech synthesis machine require the user to be inherently literate. The present invention allows a user to explore language and to develop their own literacy as the present invention in effect allows the user to "babble" in a manner akin to the way a young child babbles when the child is learning language. In addition, the present invention may be used without visual feedback and will allow users to maintain eye contact whilst speaking. This feature is particularly useful when the present invention is to be used by those with a mental or physical impairment.

Figure 15:
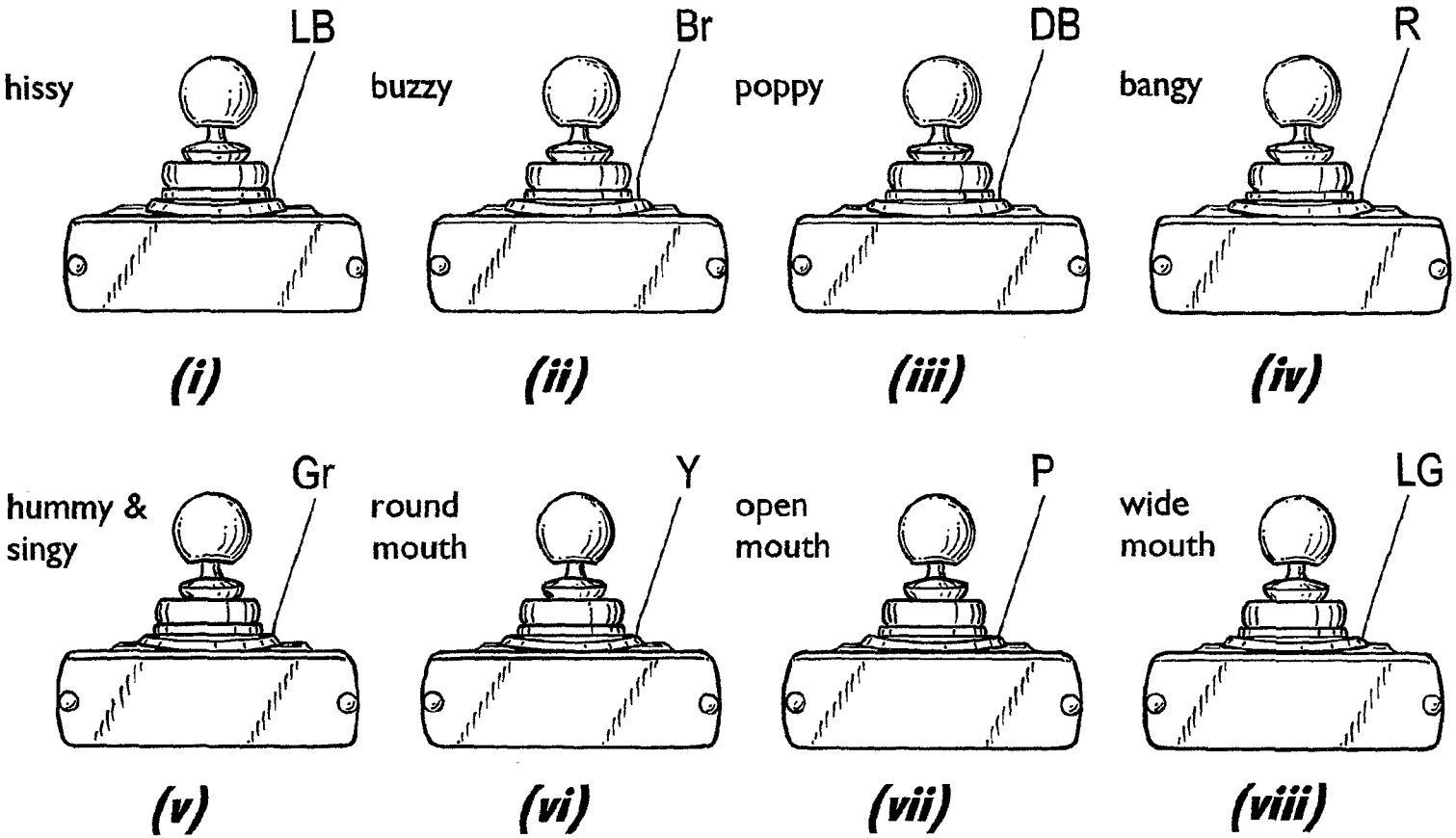
FIGS. 15 (*i*) to (*viii*) shows a user interface in accordance with the invention containing illumination means.

Other embodiments of the present invention are envisaged when a visual interface may be useful. For example, the use as a speech generator on a mobile telephone or other personal communication device may be assisted by the presence of a visual indicator. This type of visual indictor is shown in FIG. 15. In this example, the joy stick is adapted to be illuminated in a specific colour that relates to the type of phonic state that has been selected.

As can be seen in FIG. 15, if the initial selection is hissy, buzzy, poppy, bangy, hummy and singy, round mouth, open mouth or wide mouth, colours light blue, brown, dark blue, red, green, yellow, pink or light green respectively are shown in an illuminated section.

Further advantages are that many individuals with severe motor and speech impairments are able to use the joystick to manoeuvre a wheel chair; therefore this type of interface would be relatively easy for them to use.

The cognitive load that is placed upon the user may be reduced as only a relatively small amount of information relating to the movement of the joy stick needs to be remembered. In addition, the language output of the present invention is independent of output from another person; therefore linguistic items need not be pre-stored to enable a user to speak. Finally providing access to phonics will enhance the opportunities for literacy acquisition for people who use the system.

It is also envisaged that the present invention may be used as a silent cellular phone in which, rather than talking or using text that can be put on mobile phones, direct access to speech output through manipulation of the cellular phone's user interface. In addition, the present invention may provide an early "babbling" device for severely disabled children.

Improvements and modifications may be incorporated herein without deviating from the scope of the invention.

The invention claimed is:

1. A speech generation system comprising:

a user interface having a multiplicity of states each of which corresponds to a sound and a selector for making a selection of a state or a combination of states;

processing means for processing a selected state or combination of states; and an audio output for outputting the sound or combination of sounds, wherein the multiplicity of states comprise a set of primary states that represent a predefined group of sounds wherein each primary state gives access to one or more secondary state containing the predefined group, wherein the processing means forms words from the sound or combination of sounds to generate synthesized speech.

2. A system as claimed in claim 1, wherein the sounds are phonemes or phonics.

3. A system as claimed in claim 1, wherein the user interface comprises a manually operable device that allows the user to distinguish between states by manipulating the interface to a plurality of positions.

4. A system as claimed in claim 3, wherein the user interface comprises a joystick.

5. A system as claimed in claim 4, wherein each state corresponds to a position of the joystick.

6. A system as claimed in claim 4, wherein the primary states are each represented by n movements of the joystick from an initial position and wherein the secondary states are each represented by one of m movements from the position of the associated primary state.

7. A system as claimed in claim 1, wherein the selector is provided with sound feedback to allow the user to hear the sounds having been selected.

8. A system as claimed in claim 7, wherein sound feedback comprises a personal listening device to allow the user to monitor words as the words are being formed from the sounds.

9. A system as claimed in claim 7, wherein the level of sound feedback is adjustable.

10. A system as claimed in claim 1, wherein the processing means is provided with sound merging means for merging together a combination of sounds to form a word.

11. A system as claimed in claim 1, wherein the processor is provided with a module which predicts a full word on the basis of one or more combined sounds forming part of a word.

12. A system as claimed in claim 1, wherein the processing means operates to encourage the selection of more likely primary and secondary states for subsequent sounds once the primary or secondary state of the initial sound has been selected.

13. A system as claimed in claim 12, wherein the manually operable device is connected by a force-feedback system to make it easier to select certain subsequent sounds after an initial sound has been selected.

14. A system as claimed in claim 13, wherein the force-feedback system comprises a biasing means.

15. A method of generating synthetic speech, the method comprising the steps of: providing a user interface having a multiplicity of states each of which correspond to a sound, a selector for making a selection of a state or a combination of states and an audio output; selecting one or more sounds to form output speech; and, outputting said one or more sounds through the audio output; wherein the multiplicity of states, from which the selection is made, comprises a set of primary states that represent a predefined group of sounds and wherein each primary state gives access to one or more secondary states containing the predefined group of sounds and processing the selected one or more sounds to generate synthesized speech.

16. A method as claimed in claim 15, wherein the sounds are phonemes or phonics.

17. A method as claimed in claim 15, wherein the primary states are each represented by one of n movements of a user interface from an initial position and wherein the secondary states are each represented by one of m movements from the position of the associated primary state.

18. A method as claimed in claim 15, wherein the method further comprises providing sound feedback to allow the user to hear the sounds being selected.

19. A method as claimed in claim 15, wherein the method further comprises merging together a combination of sounds to form a word.

20. A method as claimed in claim 15, wherein the method further comprises displaying a series of known words from a predictive module based on an initial part of the word defined by selected sounds.

21. A method as claimed in claim 15, wherein the method further comprises encouraging the selection of more likely primary and secondary states for subsequent sounds once the primary and secondary state of an initial sound has been selected.

* * * * *